United States Patent [19]

Heinz

[11] Patent Number: 4,990,200

[45] Date of Patent: Feb. 5, 1991

[54] FITMENT APPLICATION PROCESS AND APPARATUS

[75] Inventor: Daniel Heinz, Joppatowne, Md.

[73] Assignee: Lever Brothers Company, New York, N.Y.

[21] Appl. No.: 459,052

[22] Filed: Dec. 29, 1989

[51] Int. Cl.[5] ..... B32B 31/12

[52] U.S. Cl. ..... 156/69; 53/485; 118/313; 118/320; 156/291; 156/578; 220/334; 220/359; 229/125.09; 229/125.33; 428/198; 428/201

[58] Field of Search ..... 53/485; 118/313, 320; 156/69, 291, 578; 220/270, 334, 359; 229/125.09, 125.33; 428/198, 201

[56] References Cited

U.S. PATENT DOCUMENTS

| | | | |
|---|---|---|---|
| 3,127,082 | 3/1964 | Meyer-Jagenberg | 229/125.09 X |
| 3,768,719 | 10/1973 | Johnson | 229/125.09 X |
| 4,258,876 | 3/1981 | Ljungerantz | 229/125.09 X |
| 4,732,315 | 3/1988 | Gunn | 229/125.09 |
| 4,771,937 | 9/1988 | Kamada et al. | 229/125.33 X |
| 4,858,793 | 8/1989 | Stone | 229/125.09 X |
| 4,890,758 | 1/1990 | Gailus | 156/69 X |

*Primary Examiner*—Robert A. Dawson

*Attorney, Agent, or Firm*—Gerard J. McGowan, Jr.

[57] ABSTRACT

A process for affixing reclosable pouring fitments having pouring apertures to erected cartons. In a first embodiment, adhesive is initially applied to the rear of the fitment in two parallel strips on opposite edges of the fitment. Then, the fitment is rotated 90 degrees and two more parallel strips are applied to the other two edges of the fitment. The orientation of the second set of strips is generally perpendicular to that of the first set and is such that the strips form a rectangle which surrounds the pouring aperture of the fitment. The fitment is then applied to the carton over the dispensing aperture of the carton. The generally rectangular pattern of adhesive surrounding the carton's dispensing aperture effects a continuous seal between the fitment and the carton and minimizes leakage of the product out of the carton when fitment is closed.

21 Claims, 3 Drawing Sheets

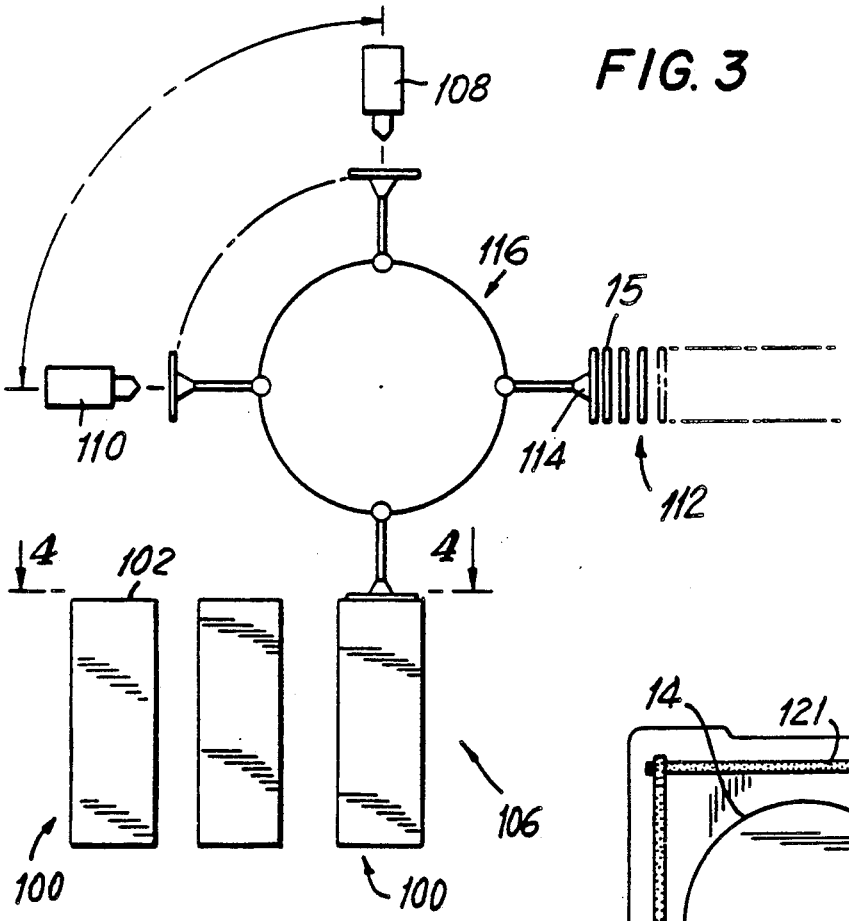
FIG. 3
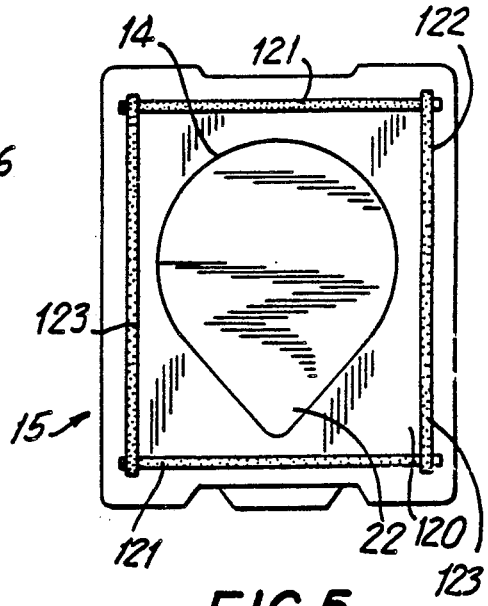
FIG. 5
FIG. 4
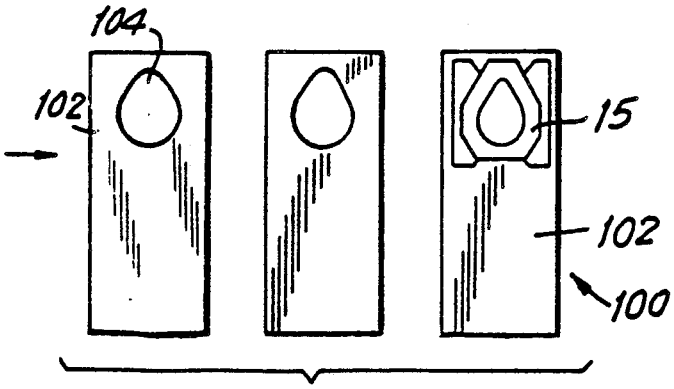

FITMENT APPLICATION PROCESS AND APPARATUS

BACKGROUND OF THE INVENTION

Powdered laundry detergents are usually sold in paperboard cartons. Unfortunately, difficulties have sometimes been encountered by consumers in neatly pouring product from cartons. Access to the product in cartons has often been provided by means of die-cut perforations in the paperboard, along which the consumer is expected to make an opening in the carton. Frequently, however, consumers find it difficult to rupture the perforations so as to make an adequate opening in the carton. An additional drawback to perforated die-cut openings is that once an opening has been made it is often difficult to control the product during pouring due to the irregular shape of the pouring aperture created by the consumer. Furthermore, openings formed in the paperboard are usually not reclosable. As a result, a tendency exists for the product to spill from the carton if tipped, especially during transport. Moreover, products which are sensitive to moisture pick-up tend to cake because of the exposed opening.

Attempts to solve the aforementioned problems have included the use of plastic fitments. Gunn U.S. Pat. No. 4,732,315 discloses a plastic closure device having an aperture configured in a pentagonal, "home plate" shape having rounded corners. However, according to Gunn, when a thin, plastic fitment is affixed to the carton in its flat, tubular form problems may arise during stacking of the tubes due to an imbalance in the otherwise flat cartons caused by the extra thickness of the fitment. Gunn discloses that the problem can be overcome by balancing the fitment with means integral with the carton. The means may, for example, comprise score lines which are thickened to offset the extra thickness of the fitment.

SUMMARY OF THE INVENTION

The present invention is directed to a process and apparatus for applying pouring fitments to cartons without the need for changes to the structure of the carton. The process comprises applying the fitment to the erected carton rather than to the flattened tubular form of the carton. The invention is particularly directed to a process of gluing the fitment to the carton in a manner for preventing leakage of the product from the carton.

In a first embodiment, the adhesive is initially applied to the rear of the fitment in two spaced parallel strips, preferably at or near two edges e.g., along the two sides. Then, the fitment is rotated 90° and two more parallel strips are applied, e.g. the top and bottom. In this way a final adhesive pattern can be used which surrounds the opening of the aperture preferably in a four-sided, even more preferably in a rectangular pattern, thereby minimizing the risk of loss of product by incomplete sealing.

In a second embodiment, one application of adhesive is made to the fitment and one is made to the carton. The adhesive applicator applies at or near two edges of the fitment two spaced parallel strips of adhesive, e.g., along the two sides. Meanwhile, a second adhesive applicator applies two spaced parallel strips of adhesive to the erected carton on opposite sides of the product pouring aperture, e.g. above and below the aperture. The fitment is then applied to the carton in a position such that the strips applied to the fitment and the strips applied to the carton are perpendicular so that the adhesive surrounds the opening preferably in a four-sided, even more preferably in a rectangular pattern to ensure proper sealing.

For a more complete understanding of the above and other features and advantages of the invention, reference should be made to the following detailed description of preferred embodiments and to the accompanying drawings.

BRIEF DESCRIPTION OF THE DRAWINGS

FIG. 3 is a partially schematic side elevational view of an apparatus carrying out the process of the the invention.

FIG. 4 is a top plan view of the cartons shown in FIG. 3 taken along lines 4—4 of FIG. 3.

FIG. 5 is a bottom plan view of a closed fitment to which adhesive ha been applied in accordance with the invention.

DETAILED DESCRIPTION OF THE INVENTION

Figure 1:
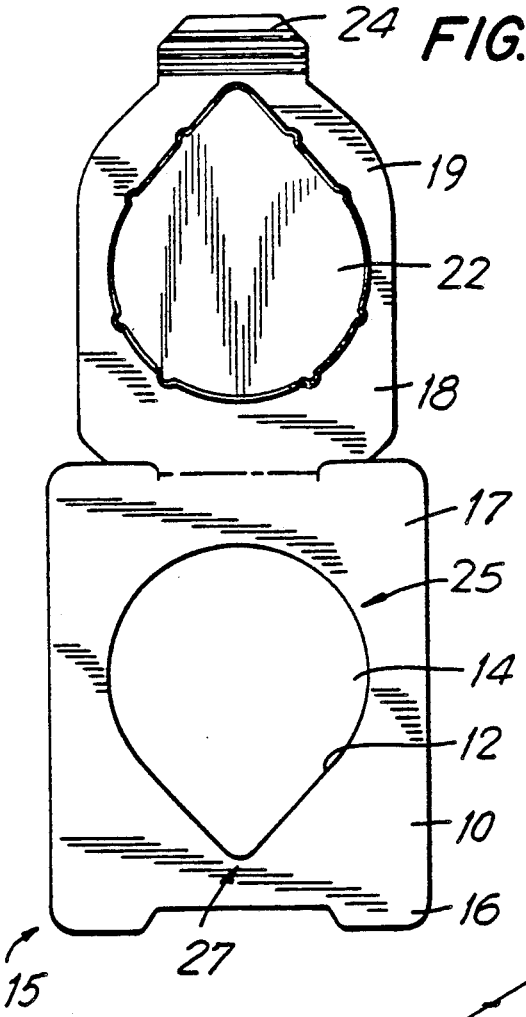
FIG. 1 is a top plan view of an opened fitment.
Figure 2:
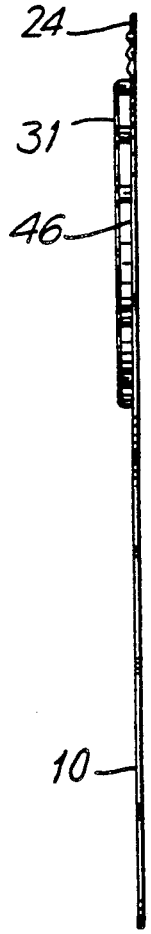
FIG. 2 is a side elevational view thereof.

Referring to Figure 1, a fitment or spout 15 comprises a base 10 having centrally disposed therein a wall 12 defining a teardrop-shaped aperture 14 surrounded by base peripheral flange 17. Two arms 16 extend from the bottom of the base at either side. A cover member 18 is hingedly associated with the base. Cover member 18 includes a generally teardrop-shaped plug 22 formed therein disposed centrally within the cover member and a cover peripheral flange 19 surrounding the plug. The cover member also includes a lift tab 24 to permit the consumer to grasp the cover member easily when opening the fitment. Wall 46 of depending plug 22 has detent nubs 31, which assist in keeping the fitment securely fastened when cover member 18 is closed by snapping plug 22 into aperture 14.

Advantageously, the teardrop-shaped aperture comprises a top half in the shape of an arc 25 and a bottom, generally V-shaped aspect 27. It is advantageous that the teardrop-shaped aperture of the invention be arranged such that the narrow end be at the bottom or pouring end of the fitment, as illustrated in FIG. 1. Fitment 15 is preferably a plastic such as glycol-modified polyethylene terephthalate (PETG), polyethylene terephthalate (PET), polypropylene, polyethylene, including high density polyethylene, and coextrusions and laminations of any of the aforementioned plastics. Polyethylene and polypropylene are particularly preferred. The fitment may be fabricated from a thin plastic to minimize the thicknesss of the fitment.

The carton is erected in the usual manner, except that the carton will include a dispensing aperture in two of its panels. Hereinafter, the carton is illustrated as having the aperture in its top panel. In general, the carton is erected by placing folded, tubular carton blanks in a carton magazine, opening a carton and placing the carton in a cartoner. In the cartoner, the bottom minor flaps are tucked in, the bottom major flaps are opened at a 90° angle, hot melt adhesive is applied, the bottom major flaps are folded and the carton is compressed to effect sealing. Subsequently the carton is filled, the top minor flaps are tucked in, the top major flaps are opened to a 90° angle and hot melt adhesive is applied, after which the top major flaps are folded and the carton is again compressed for sealing. The thus erected carton 100 having an aperture 104 in its top panel 102 is then discharged from the cartoner, turned 90° and fed into the spout placer 106 (FIG. 3).

Spout placer 106 comprises two fixed adhesive applicators, 108 and 110 respectively at two adhesive application stations, spout magazine 112, spout holders 114 and spout holder rotating apparatus 116 (shown schematically). While cartons are being erected, reclosable pour spouts 15 are fed, one at a time, from magazine 112 to a spout holder 114 (one fitment per spout holder). Spout holder 114 is conveyed by spout holder conveying apparatus 116 to a position directly below adhesive applicator 108. The rear 120 of fitment 15 (FIG. 5) faces adhesive applicator 108, which applies two spaced parallel strips of hot melt adhesive across two edges of the rear of the fitment, such as, the top and bottom edges. The fitment is then rotated 90° and moved by the spout holder conveying apparatus to a position wherein the rear of the fitment faces adhesive applicator 110. Adhesive applicator 110 then applies two parallel strips 123 of hot melt adhesive to edges perpendicular to those already coated. Thus, the orientation of the strips of adhesive applied by applicator 110 is generally perpendicular to that of the strips applied by applicator 108.

After the second adhesive applicator has applied its adhesive, the rear 120 of fitment 15 will have a generally rectangular adhesive pattern adhering thereto, as can be seen in FIG. 5. It will be noted that the pattern applied results in an endless, uninterrupted rectangle 122 of adhesive surrounding aperture 14 of the fitment. It is important that the adhesive pattern be uninterrupted to ensure that when cover 18 is secured by snapping plug 22 into aperture 14, product which exits carton dispensing aperture 104 is not able to leak through any interruptions in the adhesive sealing the rear of the fitment to the carton.

Figure 6:
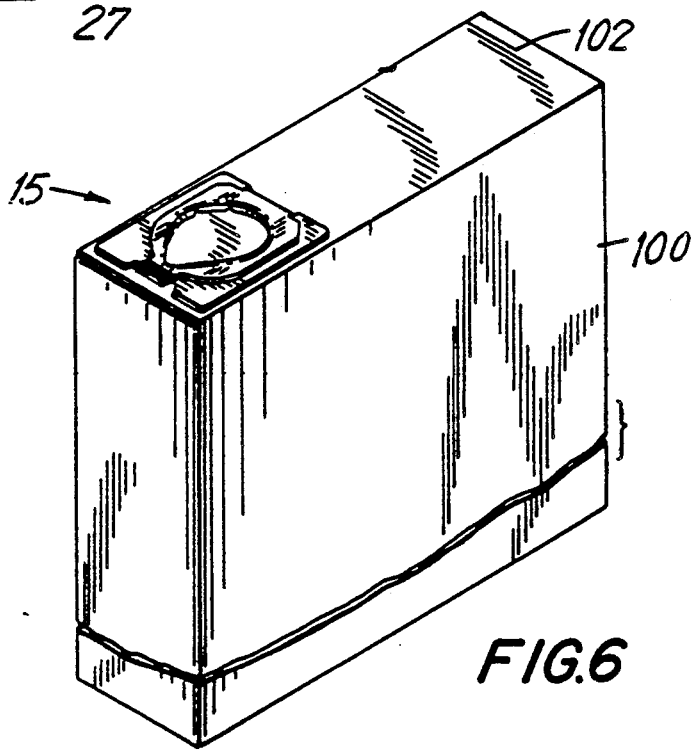
FIG. 6 is a perspective view of a carton to which the fitment has been affixed.

Once adhesive has been applied by second adhesive applicator 11 0, the fitment is conveyed by spout holder conveying apparatus 116 to a position just above carton aperture 104 and is then placed on the carton. Subsequently, the spout and carton are compressed to seal them together. The erected carton having a closed fitment sealed to the top panel is shown in FIG. 6.

Figure 7:
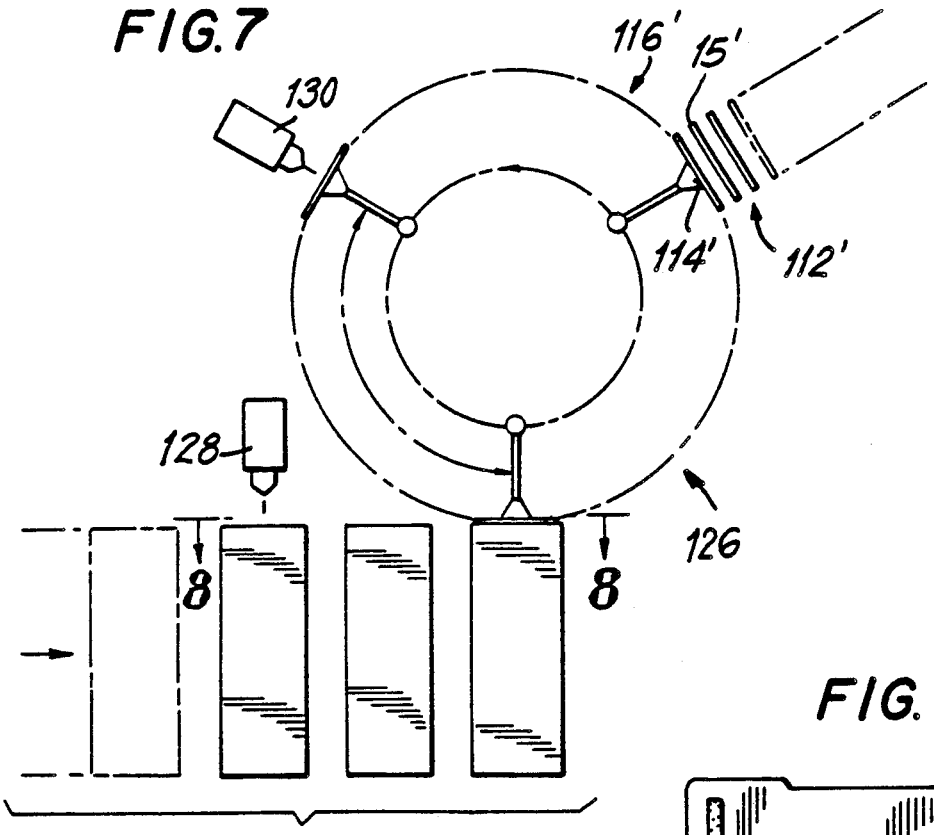
FIG. 7 is a side elevational view of an apparatus carrying out an alternate embodiment of the invention.
Figure 9:
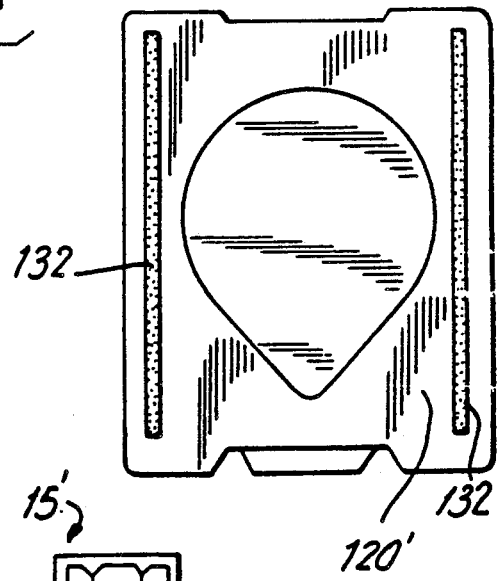
FIG. 9 is a bottom plan view of a closed fitment to which adhesive has been applied in accordance with the alternate embodiment of the invention.
Figure 8:
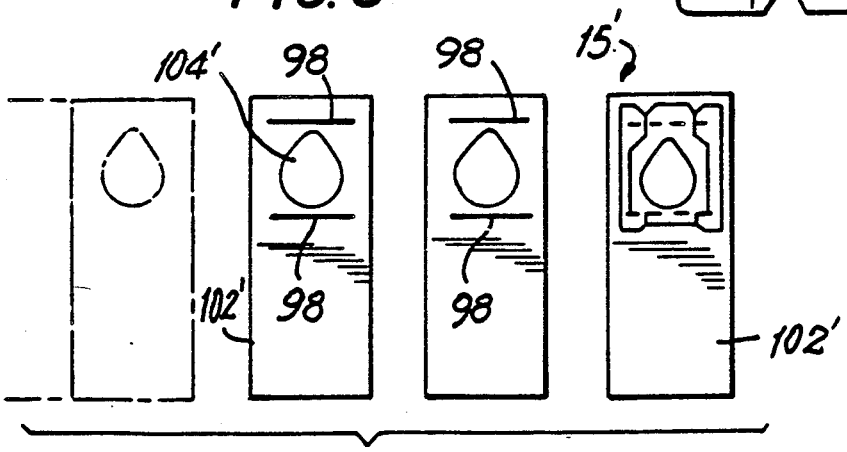
FIG. 8 is a top plan view of the cartons shown in FIG. 7 taken along lines 8—8 of FIG. 7.

In the alternative method of the invention, seen best in FIGS. 7 and 8, carton 100' is erected as before, and turned 90° and directed toward spout placer 126. Prior to contact with the fitment, the carton is postioned below adhesive applicator 128 which applies two parallel strips 98 of adhesive to top panel 102' of the carton. The parallel strips may be along either the top and bottom or along the sides of the carton aperture 104'. Preferably the strips are applied along the top and the bottom of the aperture since in this position the direction of the application of the strips corresponds to the direction of travel of the carton. Meanwhile, reclosable pour spouts 15' are fed, one at a time, from magazine 112' to a spout holder 114' (one fitment per spout holder). Spout holder 114' is conveyed by spout holder conveying apparatus 116' to a position facing adhesive applicator 130. The rear 120' of fitment 15' faces adhesive applicator 130, which applies two parallel stips 132 of hot melt adhesive across two edges of the rear of the fitment In FIG. 9, the side edges ar illustrated as being coated.

After the adhesive has been applied to the fitment, the fitment holder is conveyed to a position above a carton which has been coated with two strips of adhesive. Prior to adhering the fitment to the carton, the fitment and the carton are oriented such that the two strips of adhesive on the carton are perpendicular to the two strips of adhesive which have been applied to the fitment. Thus, once the fitment contacts the carton an endless, uninterrupted rectangular pattern of adhesive is created. The spout and carton are compressed to effect sealing and the cartons are then packed and shipped. There will be alternative ways for bringing the carton and fitment together. Depending on the way in which the carton and fitment are brought together, it may be desirable to rotate either the fitment or the carton prior to adhering the fitment to the carton in order to obtain the proper orientation whereby just prior to contact the two parallel strips adhered to the fitment are oriented in a direction generally perpendicular to that of the parallel strips on the carton.

The cartons used in the present process may be fabricated of any material normally used for that purpose. Paperboard, or paperboard laminated with one or more plastic layers, is particularly preferred. However, the carton panels may be plastic, per se, if desired. The fitment is affixed to the carton with any suitable means which can be applied by the glue applicators, especially hot melt or aqueous-based cold adhesive.

Although the invention herein has been described with respect to a particular teardrop-shaped fitment, it will be apparent that the process of the invention is relevant to the application to a carton of any fitment or other item where the need to apply adhesive in an uninterrupted pattern around an aperture or object is present. Likewise, although the process has been described with respect to application of the fitment to the top panel of a carton, it will be apparent that with minor modifications the process can be used to affix the fitment to a different panel, especially a side panel. It will be appreciated that an aperture in the side of the box will involve an opening in one layer whereas an aperture on the top of the box requires openings in inside and outside major flaps and possibly a minor flap as well.

Other changes may be made in the illustrated embodiments, as well. Therefore, it should be understood that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. A process for affixing a fitment having a pouring aperture to a carton having a product dispensing aperture, comprising (a) applying a first set of generally parallel strips of adhesive to said fitment on opposite sides of said pouring aperture, (b) applying a second set of generally parallel strips of adhesive to said fitment on opposite sides of said pouring aperture in an orientation such that an uninterrupted, endless adhesive pattern is created, (c) positioning said fitment over the carton dispensing aperture, and (d) sealingly contacting said fitment to a erected carton.

2. The process according to claim 1 wherein each set of adhesive strips is applied by a separate adhesive applicator station.

3. The process according to claim 1 wherein each fitment is initially gripped by spout holding means which is conveyed by a spout holder conveying means to a first position wherein the first set of strips are applied to the rear of the fitment by a first adhesive applicator and then to a second position wherein the second set of strips is applied by a second adhesive applicator and subsequently to a third position wherein the fitment is brought into contact with the carton.

4. The process of claim 1 wherein the fitment is rotated 90 degrees between said first and second positions whereby the strips applied by the second adhesive applicator are oriented generally perpendicular to those applied by said first adhesive applicator.

5. The process of claim 1 wherein the adhesive is a hot melt.

6. The process of claim 1 wherein each of said sets of adhesive strips is applied adjacent to an edge of said fitment.

7. The process of claim 1 wherein said first and second sets of adhesive strips form an uninterruped pattern of adhesive.

8. The process of claim 1 wherein said first and second sets of adhesive strips form a four-sided pattern of adhesive.

9. The process of claim 8 wherein the four-sided pattern of adhesive is generally rectangular.

10. The process according to claim 1 wherein said second set of parallel strips is applied in a direction generally perpendicular to said first set.

11. The process according to claim 1 wherein said fitment is plastic.

12. A process for affixing a fitment having a pouring aperture to a carton having a product dispensing aperture comprising (a) applying a first set of generally parallel strips of adhesive to said fitment on opposite sides of said pouring aperture, (b) applying a second set of generally parallel strips of adhesive to a panel of said carton on opposite sides of said dispensing aperture, (c) contacting said fitment to said carton panel over said dispensing aperture in an orientation such that said first set of parallel strips forms together with said second set of adhesive strips an endless, uninterrpted adhesive pattern.

13. The process of claim 12, wherein each fitment is initially gripped by spout holding means which is conveyed to a first position wherein the first set of strips are applied to the rear of the fitment by an adhesive applicator and then to a second position wherein the fitment is brought into contact with the carton.

14. The process of claim 12 wherein the adhesive is a hot melt.

15. The process of claim 12 wherein each set of adhesive strips is applied adjacent to an edge of the fitment.

16. The process of claim 12 wherein said first and second sets of adhesive strips form a four-sided pattern of adhesive.

17. The process of claim 16 wherein the four sided pattern is rectangular.

18. The process of claim 12 wherein said fitment is plastic.

19. Apparatus for applying a fitment to an erected carton comprising (a) spout holding means, (b) means for conveying said spout holding means to three predetermined positions, (c) a first adhesive applicator adjacent said first position, (d) a second adhesive applicator adjacent said second position, (e) means for conveying cartons to a spout-affixing position, (f) said third position being adjacent said spout-affixing position.

20. The apparatus according to claim 19, further comprising means for rotating the rear of said spout 90 degrees between said first and second positions.

21. An apparatus for affixing fitments to cartons comprising (a) spout gripping means, (b) spout gripper conveying means for conveying said spout gripper to two predetermined fitment positions, (c) a first adhesive applicator adjacent said first predetermined position, (d) carton conveying means capable of conveying cartons to two predetermined carton positions, (e) a second adhesive applicator adjacent said first predetermined carton position, (f) said second fitment position being adjacent said second carton position.

* * * * *